United States Patent [19]

Lindamood

[11] Patent Number: 4,811,647

[45] Date of Patent: Mar. 14, 1989

[54] NUT AND WASHER RETAINER AND DRIVING TOOL

[76] Inventor: David M. Lindamood, 7293 Forsythia St., Springfield, Oreg. 97478

[21] Appl. No.: 45,417

[22] Filed: May 4, 1987

[51] Int. Cl.[4] ..... B25B 13/02

[52] U.S. Cl. ..... 81/125

[58] Field of Search ..... 81/125, 55, 56

[56] References Cited

U.S. PATENT DOCUMENTS

| | | | |
|---|---|---|---|
| 2,566,257 | 8/1951 | Strunk | 81/125 |
| 2,574,352 | 11/1951 | Senter | 81/125 |
| 2,632,351 | 3/1953 | Hannah | 81/125 |
| 2,661,644 | 12/1953 | Hultquist | 81/125 |
| 2,671,369 | 3/1954 | Clark | 81/125 |
| 3,855,883 | 12/1974 | Stumph | 81/125 |
| 4,244,246 | 1/1981 | Gillett | 81/125 |
| 4,553,454 | 11/1985 | Laskey | 81/125 |
| 4,663,998 | 5/1987 | Parsons | 81/125 |

*Primary Examiner*—James G. Smith

[57] ABSTRACT

A tool equipped with a nut receiving socket with a tubular shaft extending rearwardly from the socket terminating in a handle. Housed within a shaft bore is a slidable pin having a forward segment normally projecting outwardly from the socket to permit manual placement thereon of washers and a nut element. The pin is biased forwardly by a helical spring with pin retraction occurring upon pin abutment with a threaded shaft to permit transfer of the washers and starting of the nut element onto the threaded shaft and the subsequent driving of the nut element.

4 Claims, 1 Drawing Sheet

NUT AND WASHER RETAINER AND DRIVING TOOL

BACKGROUND OF THE INVENTION

The present invention concerns fastener driving tools and particularly a tool for receiving washer and nut elements preparatory to discharging same onto a threaded shaft.

The task of applying washer and nut elements to terminals embodied in threaded shafts is particularly difficult when same are of small size as those utilized on small electrical components. Further complicating the task is the fact that electrical components with multiple terminals often include barriers in the form of flanges interposed between the terminals. The distance between such barriers is such as to receive the diameter of a nut driving socket. As the terminal ends are inset from the outer edges of the barriers, placement of washers and starting of nut elements on the terminals is extremely awkward and time consuming. This is particularly so when a workman must install several nut and washer combinations.

Prior art tools are disclosed in U.S. Pat. Nos. 3,855,883 and 4,553,454 which tools include a frictional member engageable only with a nut in place within a tool socket end prior to installation on a threaded shaft. U.S. Pat. No. 4,244,246 discloses a tool having an internal tubular magazine loaded with stacked sets of spacers, washers and nut elements for sequential attachment to threaded shafts. U.S. Pat. No. 2,671,369 discloses a magnetic socket wrench having a movable magnetic core which retains a bolt in place prior to insertion into a threaded bore. U.S. Pat. No. 3,392,767 discloses a magnetic wrench socket for retention of a nut element prior to driving engagement with a shaft. The known prior art tools fail to disclose or render obvious the presently disclosed and claimed tool.

SUMMARY OF THE PRESENT INVENTION

The present invention is embodied within a fastener driving tool which receives nut and washer elements for subsequently installing same on a threaded shaft.

The present tool may be hand or power driven and includes a socket member carried at the distal end of a tubular shaft. Slidably housed within said shaft is an elongate carrier or pin which, in one position, projects outwardly from the tool socket member to receive washer elements and then retracts into the tool shaft during a driving operation. The carrier, during driving of the nut element, is free to retract out of the way of the advancing end of the threaded shaft to permit use of the present tool for the installation of washers and nuts on threaded shafts of considerable length.

Important objectives of the present tool include the provision of a fastener driving tool having a retractable support for washer and nut elements to avoid starting same manually on a threaded shaft; the provision of a nut driving tool having a spring biased carrier which may retract a substantial distance to permit driving of the washer and nut elements home on shafts of extended length; the provision of a tool particularly suited for installing washers and nut elements into place on threaded electrical terminals having restricted access, as for example, electrical test switch components; the provision of a tool for installing washers and nut elements on a threaded post which tool is of uncomplicated design resulting in a low cost of manufacture.

DETAILED DESCRIPTION OF THE PREFERRED EMBODIMENT

Figure 1:
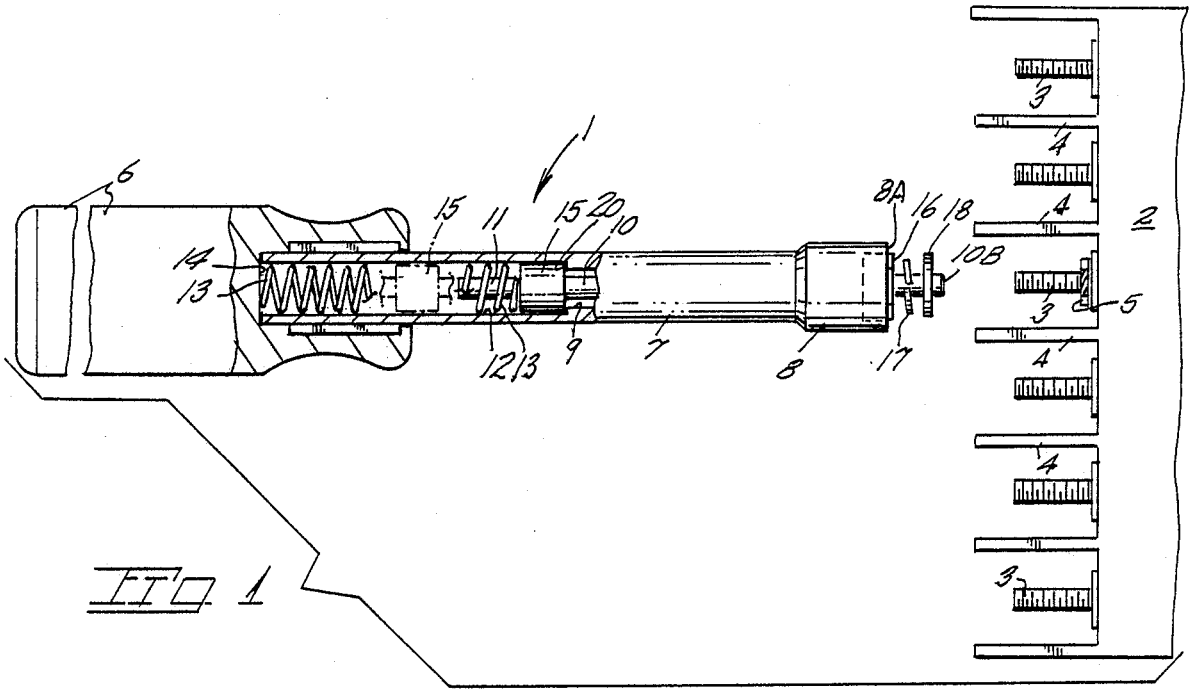
FIG. 1 is a side elevational view of the present tool with fragments broken away and offset from a terminal of a test switch shown in fragmentary form.
Figure 2:
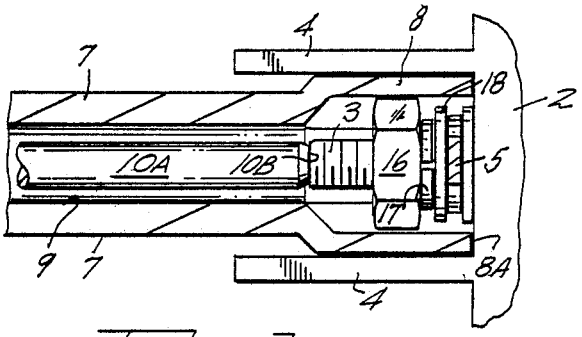
FIG. 2 is an enlarged fragmentary view of the tool socket and shank shown in section and at the completion of a nut driving operation.
Figure 3:
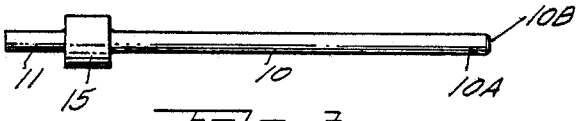
FIG. 3 is an elevational view of the carrier element removed from the tool.

With continuing attention to the drawing wherein applied reference numerals indicate parts similarly hereinafter identified, the reference numeral 1 indicates generally the tool embodying the present invention.

Indicated at 2 is an electrical test switch body having a series of terminals 3 in the form of threaded studs. Barriers at 4 are interposed between each terminal and project forwardly therepast to isolate same and prevent any current flow therebetween. A lead terminal is at 5. Typically, in test switches the barriers 4 are spaced less than an inch from one another to render the manual application of washers and a nut on the terminal post a difficult and time consuming task. The end of each terminal post, inset from the barrier outer edge, additionally complicates the task. The space between each of the barriers 4 is such as to admit entry of a wrench socket with minimal or zero clearance between the socket wall and a pair of barriers.

A tool socket at 8 is carried by a tubular shaft 7 with the latter terminating at its remaining end within a handle 6. Slidably carried within tubular shaft 7 is a carrier 10 shown in the form of a pin having a forward end segment 10A normally occupying and projecting forwardly beyond an end 8A of socket 8. A bore 9 within shaft 7 receives pin 10 while a counter bore at 12 receives a boss 15 on the pin and a pin inner end segment 11. Pin 10 may be magnitized for washer retention.

A helical compression spring 13, within counter bore 12, is confined to one end by an internal wall 14 of handle 6 while the remaining end of spring 13 is in abutment with boss 15 on carrier 10. Accordingly, carrier 10 is biased by spring 13 so as to locate pin segment 10A to extend forwardly out of socket 8 to permit convenient placement of a lock washer 17 and washer 18 thereon forward of a nut 16 in place of socket 8. Washer and nut combinations will vary with the task at hand.

An internal shoulder 20 of the tool shaft constitutes a limit stop limiting outward or forward movement of the carrier.

In use, after placement of the washer on segment 10A, the tool is advanced so as to engage outer pin end at 10B with the end of terminal 3. Continued advancement of the tool results in the washers being transferred onto the terminal and the nut positioned in abutment with the terminal end whereupon nut rotation by the tool socket results in starting of the nut and advancement along the terminal. As some terminals or other threaded shafts may be of considerable length, it has proven useful to form the tubular shaft 7 of the tool with the bore 9 having a diameter to axially accept the terminal or other threaded shaft. As pin segment 10A passes freely through nut 16, pin retraction is resisted only by spring 13 when a nonmagnitized pin is used (or a magnitized or nonmagnitized pin is used to place nonferous washers) in a less than horizontal position, the washers will be held manually by the operator on the pin segment 10A.

Boss 15 on the carrier is in sliding frictional engagement with the surface of counter bore 12 to stabilize the carrier against lateral displacement.

While I have shown but one embodiment of the invention, it will be apparent to those skilled in the art that the invention may be embodied still otherwise without departing from the spirit and scope of the invention.

Having thus described the invention, what is claimed and desired to be secured in a Letters Patent is:

1. A tool for placing a washer and starting a nut element on a threaded shaft and driving the nut element, said tool comprising, a socket for rested retention of the nut element and subsequently imparting torque to the nut element, a tubular shaft extending rearwardly from said socket and defining a lengthwise bore in communication with the interior of said socket, means for imparting torque to said tubular shaft, an elongate pin slidably and centrally disposed in said bore and having a forward segment normally projecting through said socket and freely through a nut element when in said socket and projecting forwardly from said socket, spring means biasing said pin forwardly to enable the manual placement of a washer on the pin forward segment, washer being held manually on pin by operator for less than horizontal position of nonmagnitized pin, or magnitized or nonmagnitized pin placing nonferous washers, said elongate pin being rearwardly displaceable upon endwise contact with the outer end of the threaded shaft causing the washer to be transferred onto the threaded shaft for subsequent advancement therealong by socket rotation of the nut element.

2. The tool claimed in claim 1 wherein said pin includes a boss in sliding contact with an internal wall surface of said tubular shaft defining said bore to retain the pin centrally within said bore.

3. The tool claimed in claim 2 wherein said lengthwise bore includes a counterbore within which said boss is slidably carried.

4. The tool claimed in claim 1 wherein said bore is of a diameter to admit the threaded shaft.

* * * * *